US006923030B2

(12) United States Patent
Kruger et al.

(10) Patent No.: US 6,923,030 B2
(45) Date of Patent: Aug. 2, 2005

(54) EXTERNAL ACTIVATION MECHANISM FOR PRESSURIZED FORMING CAVITY

(75) Inventors: Gary A. Kruger, Troy, MI (US); Chongmin Kim, Bloomfield Township, MI (US); Mark G. Konopnicki, Rochester, MI (US)

(73) Assignee: General Motors Corporation, Detroit, MI (US)

( * ) Notice: Subject to any disclaimer, the term of this patent is extended or adjusted under 35 U.S.C. 154(b) by 118 days.

(21) Appl. No.: 10/684,632

(22) Filed: Oct. 14, 2003

(65) Prior Publication Data

US 2005/0076690 A1 Apr. 14, 2005

(51) Int. Cl.[7] ..... B21D 26/02
(52) U.S. Cl. ..... 72/57; 29/421.1
(58) Field of Search ..... 72/57, 58, 63; 29/421.1

(56) References Cited

U.S. PATENT DOCUMENTS 2,704,104 A * 3/1955 Mueller ..... 72/31.06
4,006,619 A * 2/1977 Anderson ..... 72/54
4,510,780 A * 4/1985 Cadwell ..... 72/57
6,305,202 B1 * 10/2001 Kleber ..... 72/57
6,776,953 B1 * 8/2004 Hulsberg et al. ..... 264/570

* cited by examiner

*Primary Examiner*—Daniel C. Crane
(74) *Attorney, Agent, or Firm*—Kathryn A. Marra

(57) ABSTRACT

A mechanical mechanism is disclosed for supplementing the action of a pressurized working gas in hot blow forming of a sheet material. Opposing complementary heated forming tools grip the sheet material and form a shaping surface on one side of the sheet and a gas pressure chamber on the other side. An internal complementary mechanical forming device is located inside the pressure chamber. The device is operated by an internal rotatable shaft supported through the chamber defining tool wall. The internal shaft is coupled outside the tool wall to an external shaft for external activation of the mechanical forming device. The external shaft and coupling are enclosed in a housing structure that provide a pressure seal, thrust support and thermal insulation for the external activation mechanism.

9 Claims, 3 Drawing Sheets

206
214
200
210
204
202
216
30
208
212
54

EXTERNAL ACTIVATION MECHANISM FOR PRESSURIZED FORMING CAVITY

TECHNICAL FIELD

This invention pertains to hot blow forming a sheet material workpiece in a heated and gas pressurized chamber having a forming surface for the sheet. More specifically, this invention pertains to a machine having a activation mechanism external to the forming chamber for operating a mechanical sheet stretching device positioned in the chamber to complement the action of the gas pressure in shaping a product from the sheet material.

BACKGROUND OF THE INVENTION

In the automotive industry the hot blow forming of certain highly formable aluminum alloy sheet materials has been developed by the assignee of this invention for the forming of body panels and other parts of complex shape. In the case of superplastic AA5083 sheets, for example, such forming is often done between opposing heated tools that grip edges of a preheated sheet blank profile. One tool provides a forming surface on one side of the sheet material and the other tool provides a chamber on the other side of the sheet for application of a pressurized working gas to stretch the sheet against the forming surface. The pressurized gas, of course, applies a shaping force on the surface of the sheet.

It has been found in forming some product shapes that it would be useful to apply the force of a mechanical device to supplement the pressurized gas in stretching the sheet to shape the part. The mechanical device would be used inside the forming chamber but activated from outside the hot high pressure chamber during a stretch forming operation. In hot blow forming one to two millimeter thick AA5083 sheet material, for example, the temperature of the forming tools and sheet material is typically in the range of about 400° C. to 500° C. and air pressures of 100 to 200 psi and higher are employed. The outside mechanical actuator must be operatively connected with the internal forming device to seal against pressure and manage heat loss. It is an object of this invention to provide a mechanism or machine for such use in combination with heated and pressurized blow forming tools for sheet materials.

SUMMARY OF THE INVENTION

This invention provides a machine for the hot blow forming of a sheet material in which a pressurized working gas and a complementary mechanical device are used in stretching a heated sheet material into conformance with a forming surface.

In a hot blow forming operation, opposing, complementary forming tools are closed to grip edges of a sheet material workpiece. The forming environment is heated to a suitable stretch forming temperature for the sheet material taking into account its composition, thickness and ductility. One of the tools provides a forming surface on one side of the sheet. The opposing tool provides a chamber on the opposite side of the sheet for introduction of a pressurized working gas to stretch the heated sheet into conformance with the forming surface. As the working gas, for example air, is admitted into the pressure chamber, the pressure is gradually increased over a period of seconds or minutes to stretch the sheet against the product shape defining surface of the forming tool(s). The pressure increase at the forming temperature is scheduled and controlled to form the part rapidly but without damaging it.

Sometimes, it may be advantageous in the shape evolution of the sheet product to supplement the working gas pressure with a mechanical shaping or marking device. The mechanical device can be activated to push or mark the sheet before gas pressure is applied, during gas pressure application, or after the gas pressure has reached it maximum level. The mechanical device is located in the pressure chamber of the forming machine and brought into contact with the sheet material at an appropriate time in the forming cycle by an activation mechanism located outside the forming machine. Since the forming environment is heated and pressurized, activation of the mechanical device must be accomplished with minimal pressure and heat loss from the forming chamber.

In accordance with a preferred embodiment of the invention it is preferred that the forming tools be individually heated and their external walls covered with a suitable insulation material. The mechanical sheet forming device is made of a suitable heat resistant material and located in the pressure chamber defining tool. The forming device is activated by a rotatable shaft extending from within the pressure chamber through the wall of the chamber defining tool member. The internal end of this shaft is suitably connected to the forming device so that rotation of the shaft moves the device into contact with the sheet material for its forming contribution and then removes the device from contact with the sheet so that the sheet can be removed from the opened (separated) tools at the completion of stretch forming operation. The outer portion of the internal shaft is supported in a bushing in the wall of the chamber defining tool member, and its end is coupled with an end of a second rotatable shaft, external to the wall. Suitably the rotational axis of the external shaft is co-axial with the rotational axis of the internal shaft and both shafts are supported in a horizontal attitude. The coupling portion of the shafts and the support and pressure sealing of the external shaft is providing by a suitable housing architecture.

In accordance with a preferred embodiment, the coupling of the shafts is enclosed within a first housing attached to the tool wall. This first housing extends axially with respect to the coupled shafts through the thickness of the insulation on the tool wall and is suitably formed of a heat resistant, relatively low thermal conductivity metal. A second housing attached to the end of the first housing axially along the external shaft contains and provides thrust support for the external shaft against expulsion of the shaft by the pressurized gas in the forming chamber. A third housing attached to the second housing contains a gas seal to retain the working gas in the forming chamber. This third housing may also be provided with cooling fins for the external shaft.

Torque for rotation of the external shaft is suitably applied axially external to the housings. And means for fluid cooling of the external shaft may be provided at its external end.

The insulation of the forming tools and the structure of the housing members enable the external shaft to be rotated to operate the internal shaft and its connected mechanical shaping device without pressure loss and excessive thermal loss from the hot blow forming tools. Timely rotation of the external shaft during forming of the sheet material is accomplished using any suitable torque applying mechanism. For example, a hydraulic or pneumatic cylinder and connecting rod may be used to rotate the shaft. As another example, an electric motor can be controlled to rotate the shaft to activate the internal mechanical sheet material shaping device. These items and their controls are located outside of the aggressive high temperatures, high pressure forming environment for the sheet material.

Other objects and advantages of the invention will become more apparent from a detailed description of preferred embodiments with follow.

DESCRIPTION OF THE PREFERRED EMBODIMENT

The continued use of hot blow forming processes as applied to suitably formable aluminum sheet metal alloys for automotive vehicle body panels and the like has led to improvements in the functionalities and features of the forming tools. The developments started with relatively slow superplastic forming (SPF) practices with fine grain, magnesium containing, aluminum alloys considered as SPF materials and has led to faster forming practices called quick plastic forming (QPF) by the assignee of this invention. Double-action forming tools for preforming and final shape forming of a sheet metal workpiece on the same tool set have been developed. Also tools with internal heaters and insulated walls have been developed for the stretch forming of aluminum sheet metal alloys. Such self-heating technology has required well insulated tools, which in turn creates cool, ambient zones around the tool that can be utilized for placement of other auxiliary mechanisms. The double-action tool technology, especially in applications where the first-stage operation is of mechanical nature can utilize such auxiliary mechanisms. However, situations arise when the extra pre- or post-QPF operation is of such a minor scale that construction of a full-blown double-action tool is not warranted for technical reasons as well as for economic reasons.

In these cases, one may desire an externally actuated mechanism, which will carry out the desired mechanical forming operation. A key requirement of such a mechanism is that it has to be pressure-tight when installed into the QPF or other forming tool. The subject invention provides a mechanical device that enables mechanical forming before, during or after the main QPF operation while maintaining necessary pressure tightness. One example illustrated in this specification is a workpiece stuffing operation often used in combination with the hot blow process using pressurized air or other suitable working gas. In a typical stuffing operation the sheet metal workpiece is stretched into a concave cavity close to the shape forming tool surface with a mechanical roller. Then the pressurized working gas is used to finish the shape development of the sheet material by further stretching it into full conformance with the tool surface.

Figure 1:
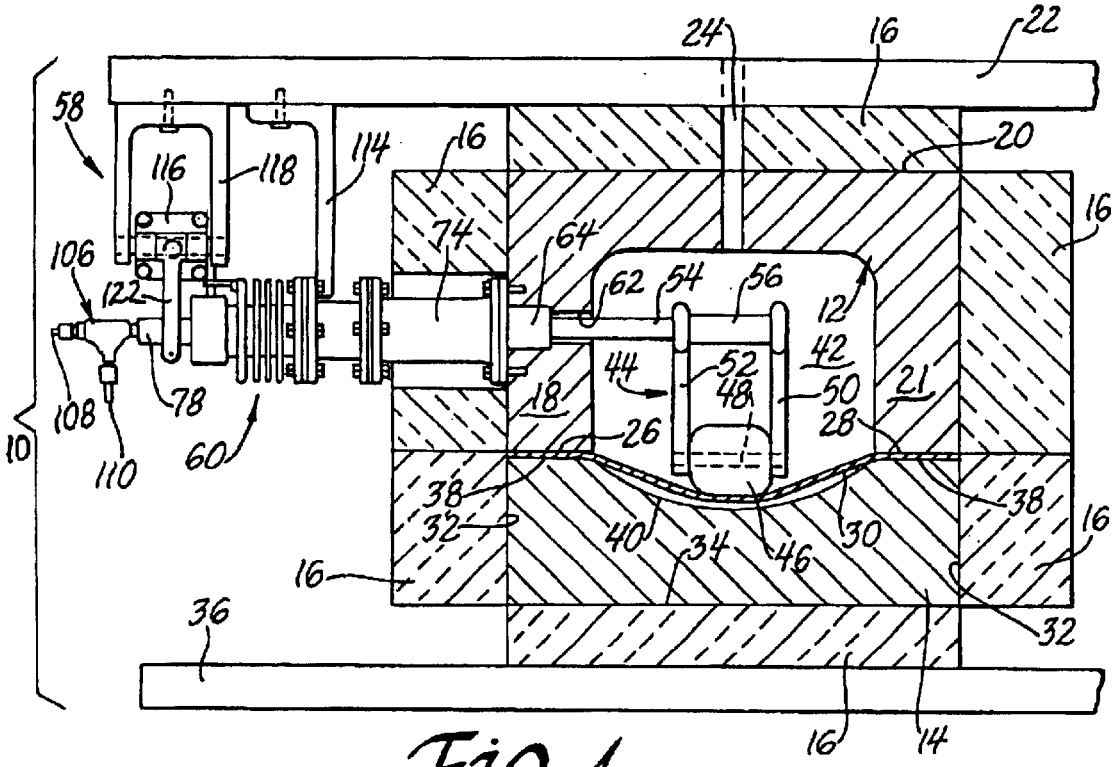
FIG. 1 is a front elevation view of heated, thermally insulated, and gas pressurized, upper and lower complementary, sheet metal hot blow forming tools, shown in cross section with both the inside-the-forming-chamber portion and the external activation portion of the mechanical former shown.

FIG. 1 illustrates a combination 10 of hot blow forming tools with an externally activated mechanical roller stuffer device for preforming the sheet material. Combination 10 includes an upper forming tool 12 and a lower forming tool 14, both made of steel and shown in cross-section. Both forming tools 12, 14 are individually heated with internal electrical resistance heating rods, not shown. The operating temperatures of the tools may be separately controlled. In the case of the hot blow forming of AA5083 sheet material, forming tools 12, 14 will be heated to a controlled temperature in the range of about 400° C. to 500° C.

Upper forming tool 12 is covered on each of its side walls, two visible at 18 and 21 in FIG. 1, and top 20 with suitable thicknesses of insulation 16. Upper forming tool 12 is attached to and supported by upper press platen 22. Upper tool 12 also has a duct 24 for the admission and venting of a working gas. Duct 24 extends through insulation thickness 16 and upper platen 22. Bottom edge 26 of side wall 18 and bottom edge 28 of side wall 20 of upper tool 12 press against the edges of sheet metal workpiece 30, shown in cross-section in FIG. 1 to secure them for the hot blow forming operation.

Lower forming tool 14 also has suitable thicknesses of insulation 16 on side walls 32 and bottom 34. Lower tool 14 is supported on lower press platen 36. Upper edges 38 of side walls 32 of lower forming tool 14 press against the edges of sheet metal workpiece 30. Lower tool has a forming surface 40 that defines a concave cavity below a sheet material workpiece placed over lower tool 14 for forming.

Upper tool 12 and lower tool 14 have a spaced part open position for removal of a finished sheet material workpiece and for insertion of a new sheet metal blank. This position of forming tools 12 and 14 is not illustrated in FIG. 1. In FIG. 1 the tools are shown in their closed position gripping the edges of a sheet material workpiece 30 for forming into a product shape defined by forming surface 40. Upper tool 12 defines a chamber 42 above sheet material 30 for a pressurized working gas to be admitted through duct 24. In the practice of this invention, chamber 42 also contains a mechanical sheet material stuffing device 44.

Stuffing device 44 comprises roller 46 carried on roller axle 48. Axle 48 is carried on radial arms 50, 52 which are attached to internal rotatable shaft 54. Radial arms are separated by spacer 56 in their connection to internal shaft 54.

Figure 2:
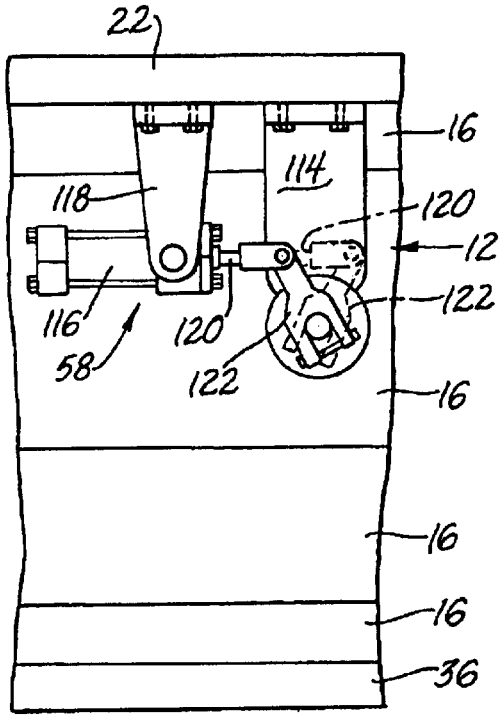
FIG. 2 is a fragmentary side view of the forming tools and side view of the external activation portion of an embodiment of the mechanical sheet forming mechanism of this invention.
Figure 3:
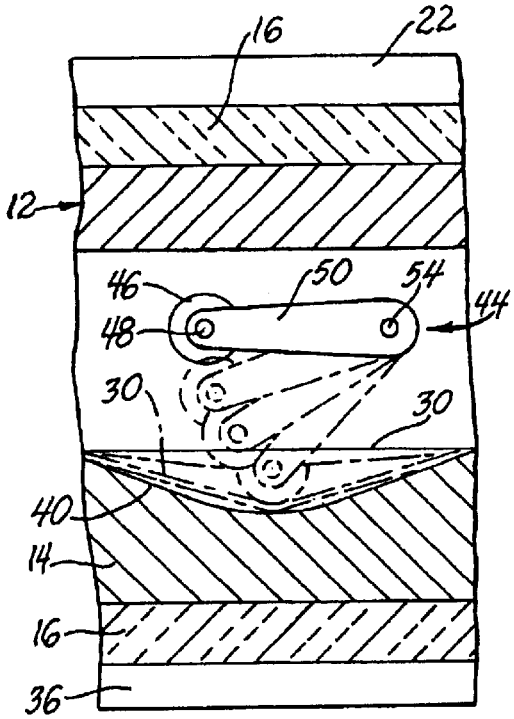
FIG. 3 is a fragmentary side view of the forming tools, in cross-section, showing the forming movement of the inside-the-forming-chamber portion of the mechanical sheet forming mechanism.

The operation of stuffing device 44 is illustrated by reference to FIGS. 1–3. In FIG. 3, stuffing device 44 is shown in its horizontal position (solid line) for removal of a shaped sheet material part and insertion of a new sheet material blank. When the blank is in place between upper 12 and lower 14 forming tools in their closed position, the stuffing device 44 is rotated by external pneumatic actuator 58 (FIGS. 1 and 2) as will be described in more detail below. Stuffing device 44 is progressively moved from its horizontal position downwardly toward the sheet material blank gripped between the forming tools 12, 14. Roller 46 is brought into rolling contact with the upper surface of sheet material 30 to deform it (i.e., stuff it) into the cavity formed between the sheet material and forming surface 40. Thereafter, pressurized air is admitted into chamber 42 to complete the stretch forming of sheet material 30 against forming surface 40.

Figure 4:
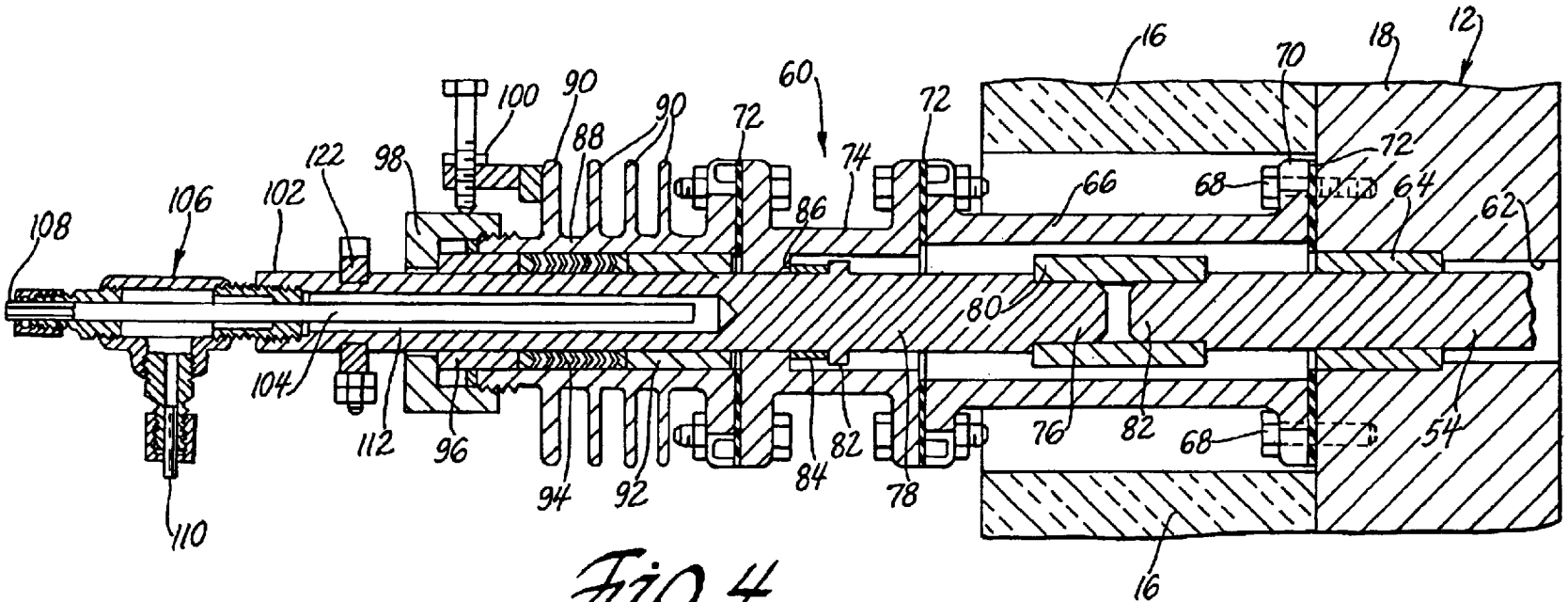
FIG. 4 is a side view of the activation portion of the mechanical sheet forming mechanism. This view is enlarged for illustrating more detail of the mechanism as compared with FIG. 1 and in cross-section.

FIG. 4 shows a section view of a preferred embodiment of an external actuating mechanism 60 for coupling with internal shaft 54 and rotating it and stuffing device 44 (not shown in FIG. 4) in the mechanical stuffing portion of the forming operation. FIG. 1 shows a frontal elevation of the activation mechanism 60 as it is mounted to upper press platen 22 and side wall 18 of upper forming tool 12.

Wall 18 of upper forming tool 12 and chamber 42 is machined with a clearance hole 62 for internal shaft 54 (broken off in FIG. 4) and counter-bored to accept a high temperature bushing 64. A first, end flanged, cylindrical housing 66, made of austenitic stainless steel to minimize heat flow, is bolted (bolts 68) through flange 70 to forming tool wall 18 and sealed with a high temperature gasket 72. This first cylindrical housing 66 passes through insulation 16 and is attached (shown bolted) using another high temperature gasket 72 to a second, end flanged, cylindrical stainless steel housing 74. Within first housing 66 the inner end 76 of external shaft 78 is coupled with a stainless steel tubular coupling 80 to the outer end 82 of inner shaft 54. Inner shaft 54 is suitably made of high silicon stainless steel to prevent galling with the high temperature bushing. The inner shaft 54 may extend across pressure chamber 42 and be inserted in another bushing in wall 20 of the upper forming tool 12.

A portion of external shaft 78 enclosed within second housing 74 has a circumferential flange 82 to prevent the shaft 78 from being pushed out of the housings. Flange 82 rotates with or against a cylindrical thrust bearing 84 that bears on reduced diameter shoulder 86 of fixed second housing 74.

Second housing 74 is attached (shown bolted) using a third high temperature gasket 72 to an end flange on aluminum housing 88 that incorporates cooling fins 90 and contains a high temperature bronze sleeve bearing 92 as well as the pressure seal 94. In this embodiment, pressure seal 94 comprises a series of Teflon "V" ring seals. But as an alternative embodiment several O-rings could be set in grooves in the circumference of external shaft 78 at this region of its length. A compression sleeve 96 is pushed by the compression nut 98 to affect the seal between external shaft 78 and the third housing, aluminum 88. Locking mechanism 100 anchored to a cooling fin 90 prevents compression nut 98 from turning.

The external rotary shaft 78 is made of austenitic stainless steel and is drilled and tapped to form axial hole 112 at its outer end 102 to accept a stainless steel tube 104 and T fittings system 106. Water is injected into end 108 of tube 104 through to axial hole 112 of the external shaft 78 and exhausted through the lower tube 110.

External shaft 78 is suspended from upper press platen 22 by flanged hanger 114. As seen in FIGS. 1 and 2, flanged hanger 114 is bolted to platen 22 and is also attached to housing member 74.

In order to operate stuffer 44, pneumatic actuator 58 is used to rotate external shaft 78. Pneumatic actuator 58 comprises pneumatic cylinder 116 which is suspended from upper press platen 22 by U-shaped hanger bracket 118. Pneumatic cylinder 116 contains a piston, not shown, which reciprocates in cylinder 116 in response to air pressure and moves piston rod 120. Piston rod 120 moves lever arm 122 which is secured to and rotates external shaft 74. Piston rod 120 and lever arm 122 are shown in a piston rod 120 withdrawn position (solid line) and piston rod 120 extended position (dashed line) in FIG. 2.

The "stuffing" application illustrated in FIG. 3 inside the pressurized upper tool 12 is used to mechanically assist the hot blow forming of sheet material 30. Mechanical stuffing can be used to improve panel thinning in a particular area or to reduce a metal fold condition.

FIGS. 5A–5D depict another application of a mechanical assist in a hot blow forming operation. In this embodiment, internal shaft 54 is used to obtain a mechanical action on sheet material 30 shown in fragmentary form. Rotation of internal shaft 54 effects a linear action on straight bar 200 and stamping die 202 attached at lower end 204 of bar 200. Round upper end 206 of bar 200 is carried in bracket 208 attached to upper tool 12 (not shown). The round upper end 206 of bar 200 slides in a hole in bracket 208. Cam 210 is fixed to the end of internal shaft 54 and cam 210 acts on cam follower 212 attached to a side of bar 200.

Figures 5A, 5B, 5C, 5D:
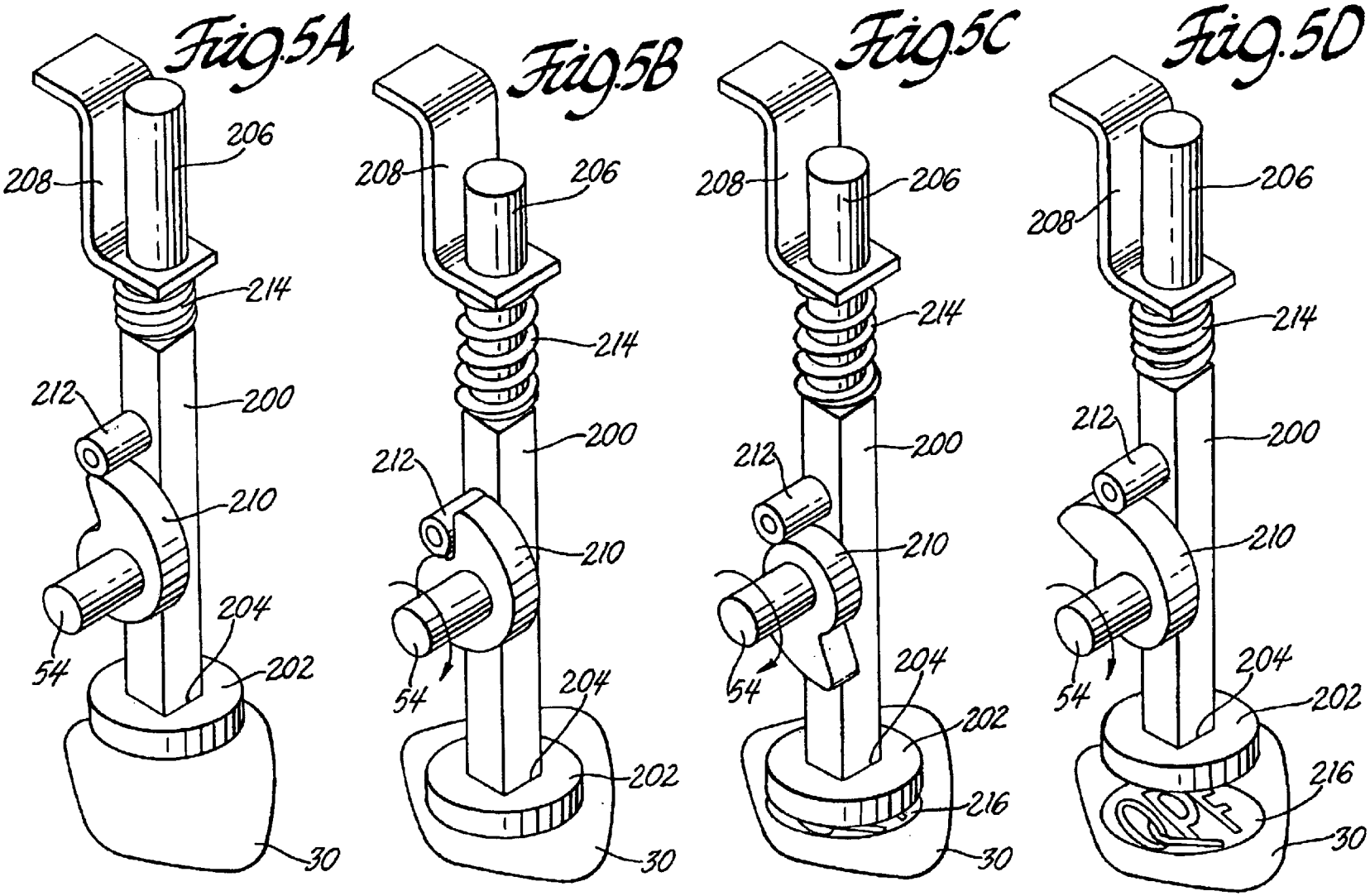
FIGS. 5A–5D are oblique side views illustrating the functional motion of an alternative embodiment of the sheet metal forming portion of this invention.

During a rotation of shaft 54 and cam 210, bar 200 is raised against high temperature coil spring 214, FIG. 5A. In this position die 202 is elevated above sheet material 30 as, for example, it is being formed by application of working gas pressure. Upon further rotation of cam 210, FIG. 5B, coil spring is released and it forces rod 200 downwardly with die 202 contacting a previously formed portion of the sheet material 30. In this example the die coins an emblem on the upper surface of the sheet material 30. Progressive rotation of shaft 54 and cam 210 elevates rod 200 to reveal the QPF emblem 216 coined on the surface of the sheet material.

Thus, a mechanical forming action of this embodiment could be used to "coin" sharp features on the exterior of a part or provide a locating feature for post form operations.

The mechanical external activation and internal forming mechanism of this invention provides a complementary action in the hot blow forming of a sheet material. The mechanism is capable of many different mechanical forming applications for assisting the forming action of the working gas in the complementary forming tools. While the invention has been illustrated in terms a few representative embodiments it is apparent that other forms could readily be adapted by one skilled in the art. And the invention is intended to be limited only by the scope of the following claims.

What is claimed is:

1. A machine for hot stretch forming of sheet material comprising:

two or more opposing tool members adapted to close upon and grip edges of a workpiece of said sheet material during forming of said sheet material, one of said tool members having a forming surface for one side of said sheet material workpiece and the second of said members providing a walled chamber for pressurized gas on the other side of said sheet material workpiece, said tools being heated for the stretch forming of said workpiece;

a first rotatable shaft with a first end supported for rotation in a wall of said walled chamber, said first end extending through said wall, and a second end for actuating a mechanical sheet material forming tool in said walled chamber;

a second rotatable shaft having a first end for coupling to said first end of said first shaft for rotation of said first shaft, and a second end;

a coupling connecting the first end of the second shaft to the first end of the first shaft; and a housing enclosing said coupling and comprising a pressure seal for the pressurized gas in said chamber.

2. The machine for hot stretch forming of sheet material as recited in claim 1 comprising said second rotatable shaft aligned with the rotational axis of said first shaft, the second shaft having said first end for rotational coupling to said first end of said first shaft, and said second end.

3. The machine for hot stretch forming of sheet material as recited in claim 1 in which said housing comprises a first portion attached to the wall of said walled chamber and enclosing the first ends of said first and second rotatable shafts and said coupling, and a second portion rigidly attached to the first portion and enclosing a pressure seal for the pressurized gas in said chamber.

4. The machine for hot stretch forming of sheet material as recited in claim 1 in which said housing comprises a first portion attached to the wall of said walled chamber and enclosing the first ends of said first and second rotatable shafts and said coupling, a second portion rigidly attached to the first portion and enclosing a thrust bearing engaging the second shaft, and a third portion rigidly attached to the second portion and enclosing a seal for the pressurized gas in said chamber.

5. The machine for hot stretch forming of sheet material as recited in claim 1 in which said tools are individually internally heated for the stretch forming of said sheet material.

6. The machine for hot stretch forming of sheet material as recited in claim 1 in which the walls of said walled chamber comprise a thickness of thermal insulation.

7. The machine for hot stretch forming of sheet material as recited in claim 3 in which the walls of said walled chamber comprise a thickness of thermal insulation and at least some of the first portion of said housing is located within the thickness of said insulation.

8. The machine for hot stretch forming of sheet material as recited in claim 1 in which a mechanism for rotating said second rotatable shaft is connected to the second end of said shaft.

9. The machine for hot stretch forming of sheet material as recited in claim 1 in which a mechanism for rotating said second rotatable shaft is connected to the said shaft and the second end of said shaft comprises an inlet for a cooling fluid.

* * * * *